US008042512B2

(12) United States Patent
Scharp

(10) Patent No.: US 8,042,512 B2
(45) Date of Patent: Oct. 25, 2011

(54) PISTON FOR AN INTERNAL COMBUSTION ENGINE AND METHOD FOR ITS PRODUCTION

(75) Inventor: Rainer Scharp, Vaihingen (DE)

(73) Assignee: MAHLE International GmbH, Stuttgart (DE)

( * ) Notice: Subject to any disclaimer, the term of this patent is extended or adjusted under 35 U.S.C. 154(b) by 440 days.

(21) Appl. No.: 12/308,238

(22) PCT Filed: Jun. 8, 2007

(86) PCT No.: PCT/DE2007/001010

§ 371 (c)(1),
(2), (4) Date: Dec. 10, 2008

(87) PCT Pub. No.: WO2007/143967

PCT Pub. Date: Dec. 21, 2007

(65) Prior Publication Data

US 2009/0288632 A1 Nov. 26, 2009

(30) Foreign Application Priority Data

Jun. 13, 2006 (DE) ..... 10 2006 027 355

(51) Int. Cl.
*F02F 3/18* (2006.01)

(52) U.S. Cl. ..... 123/193.6; 29/888.042

(58) Field of Classification Search ..... 123/193.6, 123/41.35; 92/186, 231; 29/888.042
See application file for complete search history.

(56) References Cited

U.S. PATENT DOCUMENTS

| | | | | |
|---|---|---|---|---|
| 3,181,514 | A | 5/1965 | Druzynski | |
| 5,937,174 | A | 8/1999 | Weber | |
| 6,279,455 | B1 | 8/2001 | Kruse | |
| 2005/0092279 | A1 * | 5/2005 | Parker et al. | 123/193.6 |
| 2007/0251487 | A1 * | 11/2007 | Heidrich et al. | 123/193.6 |

FOREIGN PATENT DOCUMENTS

| | | |
|---|---|---|
| DE | 589 436 | 11/1933 |
| DE | 1 001 862 | 1/1957 |
| DE | 10 25 221 | 2/1958 |
| DE | 1 033 954 | 7/1958 |
| DE | 12 51 588 | 11/1964 |
| DE | 1 583 747 | 9/1970 |
| DE | 2 017 925 | 10/1971 |
| DE | 35 18 497 | 11/1986 |
| DE | 101 28 737 | 1/2003 |
| DE | 102 16 328 | 10/2003 |
| DE | 10 2004 003 980 | 8/2005 |

(Continued)

OTHER PUBLICATIONS

International Search Report.

*Primary Examiner* — M. McMahon
(74) *Attorney, Agent, or Firm* — Collard & Roe, P.C.

(57) ABSTRACT

Proposed is a piston (1) for an internal combustion engine having a closed annular duct (4) which is arranged close to the piston head (5) and radially at the outside, which annular duct (4) has, at the piston head side, an annular opening (21) which, in section, has the shape of a trapezium with limbs which taper conically in the direction away from the piston head, and which is closed off by an annular closure element (3) which, in section, has the same trapezium shape as the opening (21), with the closure element (3) being fastened in the opening (21) by means of friction welding.

3 Claims, 1 Drawing Sheet

FOREIGN PATENT DOCUMENTS

| | | |
|---|---|---|
| DE | 10 2004 019 012 | 11/2005 |
| DE | 201 22 470 | 1/2006 |
| FR | 1 301 299 | 8/1962 |
| GB | 358 709 | 10/1931 |
| GB | 853 382 | 11/1960 |
| JP | 58-190538 | 11/1983 |
| JP | 64-71631 | 3/1989 |
| JP | 06-002613 | 1/1994 |

* cited by examiner

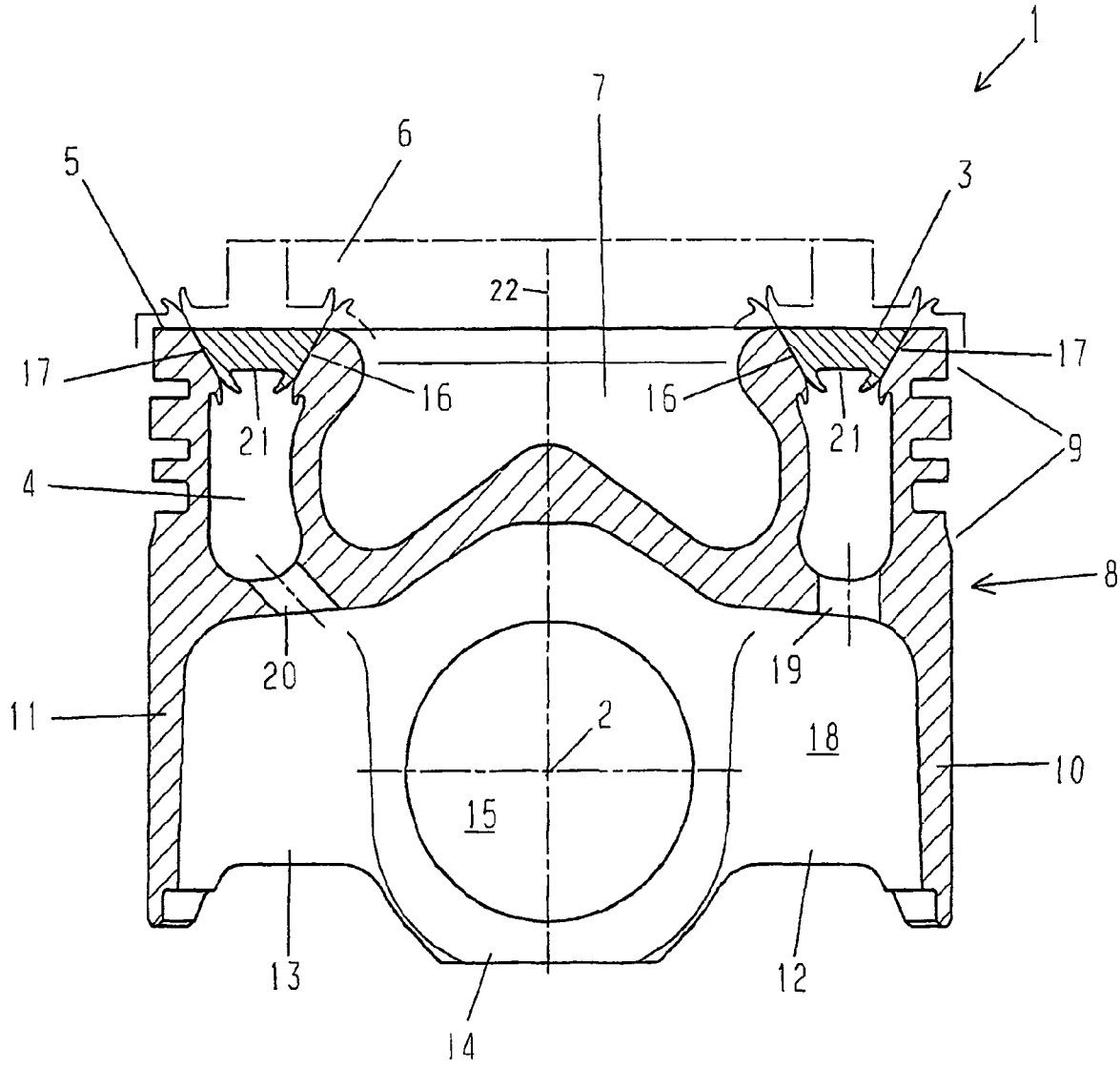
1
7
6
5
3
22
17
17
16
16
21
21
9
4
8
20
19
11
2
18
10
15
13
12
14

PISTON FOR AN INTERNAL COMBUSTION ENGINE AND METHOD FOR ITS PRODUCTION

CROSS REFERENCE TO RELATED APPLICATIONS

This application is the National Stage of PCT/DE2007/001010 filed on Jun. 8, 2007, which claims priority under 35 U.S.C. §119 of German Application No. 10 2006 027 355.9 filed on Jun. 13, 2006. The international application under PCT article 21(2) was not published in English.

The invention relates to a piston for an internal combustion engine, in accordance with the preamble of claim 1, and to a method for its production, in accordance with the preamble of claim 5.

Pistons having a ring channel that serves for accommodating oil for cooling the piston crown and the ring belt, and that is made in the piston body, proceeding from the piston crown, by means of a cutting production method, and subsequently closed off, are widely known from the state of the art.

It is known from the German Offenlegungsschrift [examined patent application published for public scrutiny] 20 17 925 and from the German patent 12 51 588 to close off the ring channel made in the piston crown with a ring-shaped closure element, which is attached in the ring channel using the charge-carrier welding method. The disadvantages of this welding method consist in the fact that it is very time-consuming and energy-intensive, and that it is very complicated because of the number of parameters that must be observed.

It is known from the German patent 10 25 221, from the British patent 853,382, and from the U.S. Pat. No. 3,181,514 to first close off a ring channel that has been made in the piston crown with a ring element, so that liquid metal that is filled into a groove situated above, to close off the ring channel, does not flow into the ring channel. For this purpose, multiple method steps are required, which make this method for the production of a ring channel very complicated and time-consuming.

Proceeding from this, the invention is based on the task of avoiding the aforementioned disadvantages of the state of the art, and of creating a method for the production of a piston having a ring channel for accommodating cooling oil for cooling the piston crown and the ring belt, which method can be carried out in simple manner and with little expenditure of time and energy.

This task is accomplished with the characteristics that stand in the characterizing part of the main claim and of the secondary claim. Practical embodiments of the invention are the object of the dependent claim.

In this connection, the friction-welding method applied during production of the piston according to the invention has the advantages that because of its simplicity, it is well suited for automation, and that the welding times are short, and this reduces the production time of the entire piston.

The invention will be described in greater detail in the following, using a drawing. This shows a piston for an internal combustion engine, having a ring-shaped cooling channel, which is closed off, on the piston crown side, with a ring-shaped closure element.

In the FIGURE, a piston 1 for an internal combustion engine is shown in a sectional diagram that lies crosswise to the pin axis 2, in which diagram the contours of the piston 1 are drawn in after precision machining, and a ring-shaped closure element 3 for closing of a ring channel 4 is drawn in, with a holder 6, by way of which the closure element 3 is braced into a friction-welding device, not shown in the figure.

The holder 6 has the shape of an arrow, in section, the tip of which arrow is formed by the closure element 3.

The piston 1 has a piston crown 5 with a combustion bowl 7 formed into it. Radially on the outside, a ring belt 9 that consists of three piston ring grooves is worked into the mantle surface 8 of the cylindrical piston 1, close to the piston crown 5. The closed ring channel 4 is disposed between the combustion bowl 7 and the ring belt 9; on the piston crown side, it is closed off with the closure element 3, which has the shape of an equilateral trapezoid with side surfaces 16, 17 that run towards one another conically in the direction away from the piston crown, in section. The closure element 3 is welded to the piston crown 5 by means of the friction-welding method, by way of the side surfaces 16, 17. The ring channel 4 has an oil inflow opening 19 and an oil outflow opening 20, which connect the ring channel 4 with the piston interior 18.

In the direction facing away from the piston crown, two skirt elements 10 and 11 that lie opposite one another follow the ring belt 9; they are connected, on both sides, in each instance, by way of connection crosspieces 12 and 13, with two pin bosses that lie opposite one another, of which only the pin boss 14 with a pin bore 15 is shown in a top view, because of the location of the section in the figure.

The piston 1 and the closure element 3 are made of steel, thereby imparting relatively great strength and ability to withstand stress to the piston 1. Within the scope of the production process, first of all a blank is forged from steel; it has the rough outline of the piston 1, with recesses for the combustion bowl 7 and the piston interior 18. Subsequent to this, precision machining of the piston 1 takes place, using cutting production methods, such as lathing, milling, and drilling. Pin bores 15, the ring belt 9 with the piston ring grooves, the radially outer surfaces of the skirt elements 10 and 11, and the combustion chamber bowl 7 are produced in this way.

Subsequently, a recess is formed in the radially outer region of the piston crown 5, between combustion chamber bowl 7 and the outer edge of the piston crown 5, in the direction of the piston axis 22, by means of a cutting production method; this recess has the shape of the ring channel 4 and has a ring-shaped opening 21 on the piston crown side, which has the same trapezoid shape, in cross-section, as the closure element 3. An oil inflow opening 19 and an oil outflow opening 20 are drilled, starting from the piston interior 18, into the ring channel 4 that has been formed in this way.

Using the friction-welding method, the ring channel 4 is then closed off, whereby the finished piston 1 is clamped into the fixed chuck of a friction-welding device, and the holder 6 with the closure element 3 are clamped into the rotatable chuck of the friction-welding device. The rotatable chuck is put into rotation, and the rotating closure element 3 is pressed into the ring-shaped opening 21 in the crown 5 of the fixed piston 1, whereby friction heat forms in the side surfaces 16 and 17 of the closure element 3 and in the radial outer surfaces of the opening 21, because of the relative movement between the piston 1 and the closure element 3. After sufficient heat development, the relative movement is canceled out, and the closure element 3 is joined into the opening 21 under increased force. Because of the weld connection that results from this, between the piston crown and the closure element 3, the opening 21 of the ring channel 4 is closed.

The advantages of the friction-welding method consist in the fact that it is well suited for automation, and that the welding times are relatively short.

In the last method step, the holder 6 is removed from the closure element 3, and the surface of the piston crown 5 is smoothed.

REFERENCE SYMBOL LIST

1 piston
2 pin axis
3 closure element
4 ring channel
5 piston crown
6 holder of the closure element 3
7 combustion bowl
8 mantle surface
9 ring belt
10, 11 skirt element
12, 13 connection crosspiece
14 pin boss
15 pin bore
16, 17 side surface of the closure element 3
18 piston interior
19 oil inflow opening
20 oil outflow opening
21 ring-shaped opening
22 piston axis

The invention claimed is:

1. A method for the production of a piston for an internal combustion engine, having the following method steps:

forging a piston blank having a recess for the piston interior, precision machining the piston blank, using one or more cutting production methods, for the production of pin bores, a ring belt, and the radially outer surfaces of the skirt elements, forming a recess that lies in the direction of the piston axis, for use as a ring channel, having a ring-shaped opening on the piston crown side, proceeding from the piston crown, using a cutting production method, whereby the opening has the shape of a trapezoid, in section, having sides that come together conically, in the direction facing away from the piston crown, introduction of an oil inflow opening and an oil outflow opening into the ring channel, comprising the following method steps:

production of a ring-shaped closure element that has the same radial diameter and the same cross-sectional shape as the opening, and attachment of the closure element in the opening using a friction-welding method.

2. The method according to claim 1, comprising the use of steel for forging the piston blank.

3. The method according to claim 1, comprising the use of steel for the production of the closure element.

* * * * *